US006763913B1

(12) United States Patent
Adams

(10) Patent No.: US 6,763,913 B1
(45) Date of Patent: Jul. 20, 2004

(54) COVER APPARATUS

(76) Inventor: Willie Adams, 1245 N. Vine St., #207, Los Angeles, CA (US) 90038

( * ) Notice: Subject to any disclaimer, the term of this patent is extended or adjusted under 35 U.S.C. 154(b) by 0 days.

(21) Appl. No.: 10/286,740

(22) Filed: Nov. 1, 2002

(51) Int. Cl.[7] ..... A62B 1/08; A47L 3/04; B65H 59/16

(52) U.S. Cl. ..... 182/231; 182/232; 182/3; 188/65.1

(58) Field of Search ..... 182/231, 232, 182/3, 36, 236, 237, 238, 239, 240; 188/65.1, 65.2, 65.3, 65.4; 242/396.9, 396.5

(56) References Cited

U.S. PATENT DOCUMENTS 2,680,593 A * 6/1954 McIntyre ..... 182/231
3,761,082 A 9/1973 Barthel, Jr.
4,303,041 A 12/1981 Thompson et al.
4,877,110 A * 10/1989 Wolner ..... 182/232
5,186,289 A * 2/1993 Wolner et al. ..... 182/232
5,771,993 A * 6/1998 Anderson et al. ..... 182/239
6,315,138 B1 11/2001 Dyson
6,321,872 B1 * 11/2001 Parker ..... 182/3

* cited by examiner

*Primary Examiner*—Hugh B. Thompson, II

(57) ABSTRACT

A cover apparatus for reducing the force of impact between a lanyard reel and a head of a user. The cover apparatus includes a housing comprising a perimeter wall defining an interior space of the housing. The interior space is designed for receiving the lanyard reel whereby the housing is positioned around the lanyard reel. The housing is designed for being positioned between the lanyard reel and the head of user for inhibiting injury to the head of the user when the lanyard reel impacts the head of the user.

11 Claims, 3 Drawing Sheets

COVER APPARATUS

BACKGROUND OF THE INVENTION

1. Field of the Invention

The present invention relates to body harnesses and more particularly pertains to a new cover apparatus for reducing the force of impact between a lanyard reel and a head of a user.

2. Description of the Prior Art

The use of body harnesses is known in the prior art. U.S. Pat. No. 4,303,041 describes a device for being coupled around the body of the user to support the user from a support structure. Another type of body harness is U.S. Pat. No. 3,761,082 having a harness assembly being coupled to the torso of the user and is supported from a mounting means to support a user in the harness assembly. U.S. Pat. No. 6,315,138 has an overhead support system for supporting a user in a harness and allows the user to travel in multiple directions.

While these devices fulfill their respective, particular objectives and requirements, the need remains for a device that has certain improved features that absorbs the impact between a lanyard reel and the head of the user when the user is positioned in the harness.

SUMMARY OF THE INVENTION

The present invention meets the needs presented above by providing a housing that is placed over the lanyard reel when the lanyard reel is in use.

Still yet another object of the present invention is to provide a new cover apparatus that inhibits injuries to the head of the user from impacting the lanyard reel.

To this end, the present invention generally comprises a housing comprising a perimeter wall defining an interior space of the housing. The interior space is designed for receiving the lanyard reel whereby the housing is positioned around the lanyard reel. The housing is designed for being positioned between the lanyard reel and the head of user for inhibiting injury to the head of the user when the lanyard reel impacts the head of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
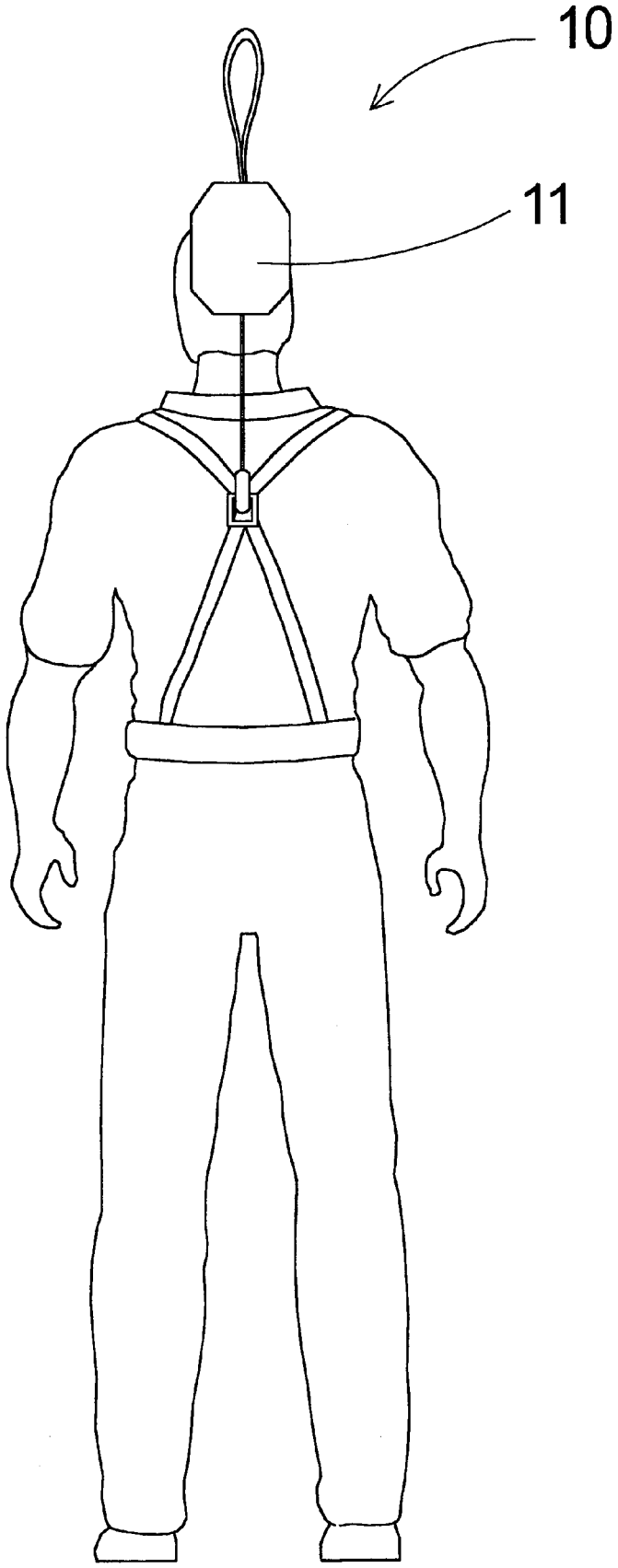
FIG. 1 is a rear view of a new cover apparatus according to the present invention in use.
Figure 2:
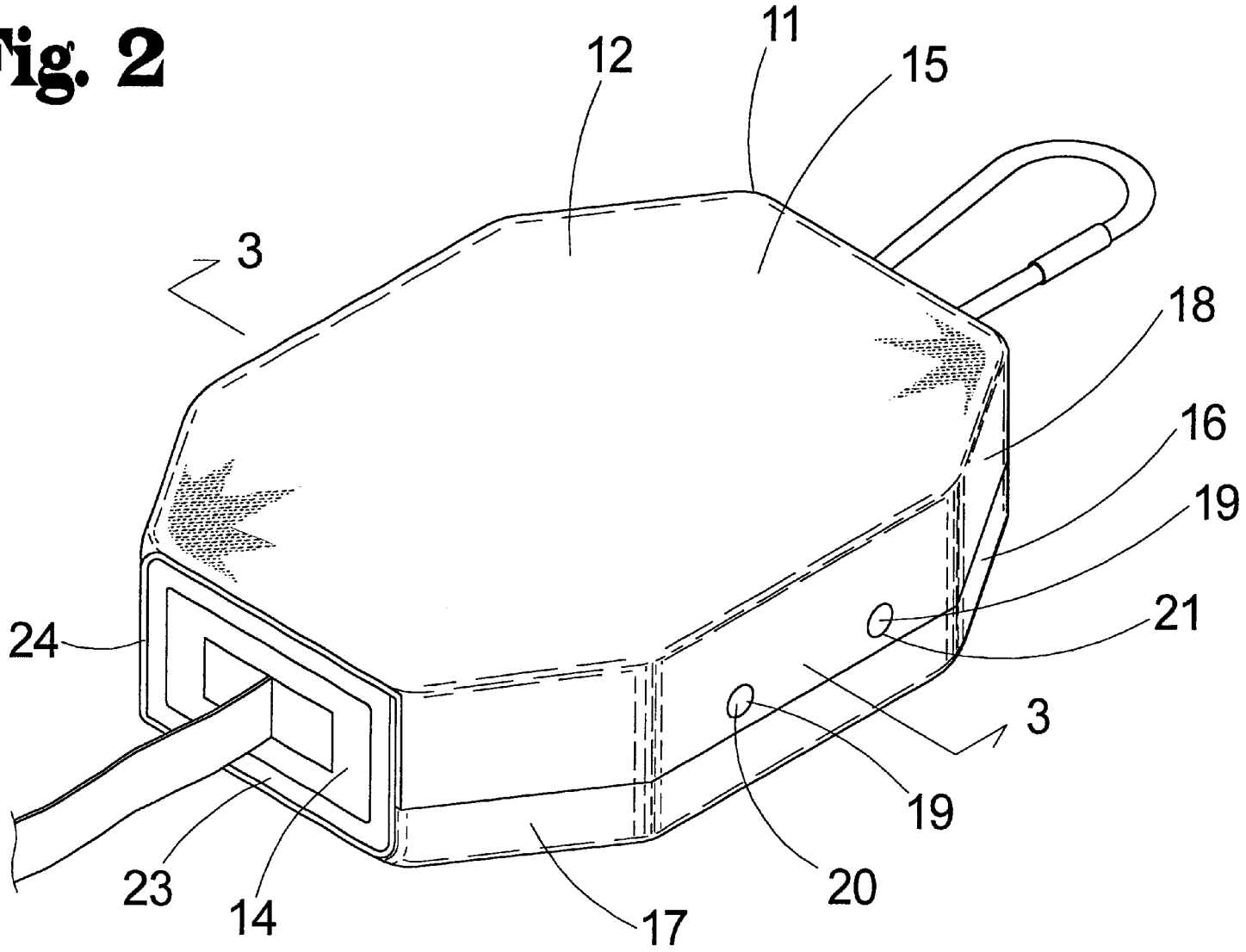
FIG. 2 is a perspective of the present invention in use.
Figure 3:
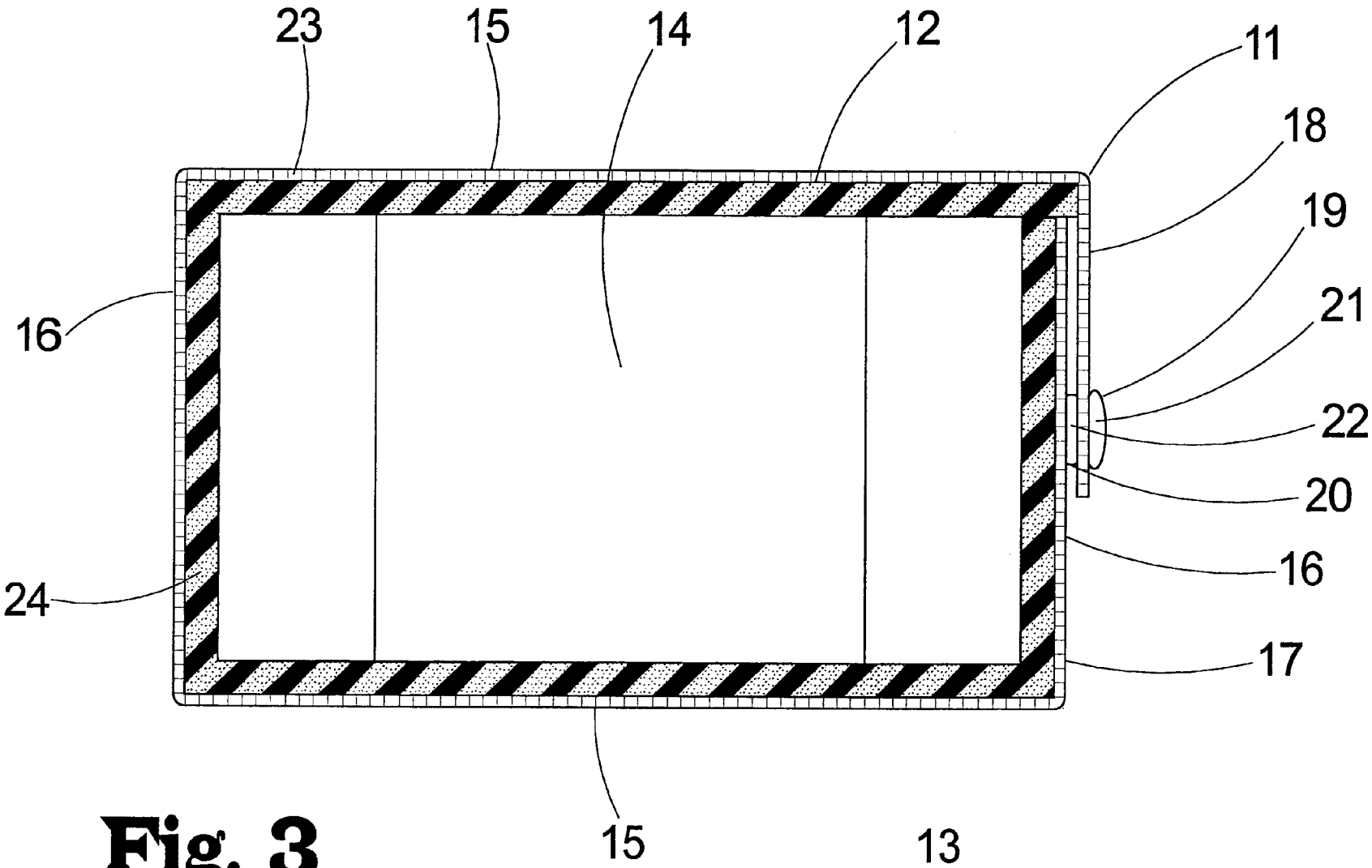
FIG. 3 is a cross-sectional view of the present invention taken along line 3—3 of FIG. 2.

With reference now to the drawings, and in particular to FIGS. 1 through 3 thereof, a new cover apparatus embodying the principles and concepts of the present invention and generally designated by the reference numeral 10 will be described.

As best illustrated in FIGS. 1 through 3, the cover apparatus 10 generally comprises a housing 11 comprising a perimeter wall 12 defining an interior space 13 of the housing 11. The interior space 13 is designed for receiving the lanyard reel whereby the housing 11 is positioned around the lanyard reel. The housing 11 is designed for being positioned between the lanyard reel and the head of user for inhibiting injury to the head of the user when the lanyard reel impacts the head of the user.

The perimeter wall 12 defines a pair of opposing open ends 14 of the interior space 13 of the housing 11. One of the open ends 14 of the interior space 13 is designed for permitting a lanyard to extend from the lanyard reel when the lanyard reel is positioned in the interior space 13 of the housing 11. The other of the open ends 14 of the interior space 13 of the housing 11 is designed for permitting a securing member to extend from the lanyard reel when the lanyard reel is positioned in the interior space 13 of the housing 11.

The perimeter wall 12 of the housing 11 comprises a pair of side walls 15 and a pair of edge walls 16. Each of the side walls 15 extends between the edge walls 16 whereby the side walls 15 are in a spaced relationship. The side walls 15 of the perimeter wall 12 are designed for being positioned adjacent sides of the lanyard reel when the lanyard reel is positioned in the interior space 13 of the housing 11. The edge walls 16 are designed for being positioned adjacent edges of the lanyard reel.

One of the edge walls 16 of the perimeter wall 12 comprises a flap portion 17 and a cover portion 18. The flap portion 17 is hingably coupled to one of the side walls 15 and the cover portion 18 is hingably coupled to the other of the side walls 15. The cover portion 18 is pivotal to be substantially aligned with the associated one of the side walls 15 whereby the flap portion 17 is pivotal to be substantially aligned with the associated one of the side walls 15 to permit the lanyard reel to be inserted into the interior space 13 of the housing 11. The cover portion 18 is pivotal over the flap portion 17 when the flap portion 17 is folded substantially perpendicular to the associated one of the side walls 15 whereby the cover portion 18 and the flap portion 17 are designed for retaining the lanyard reel in the interior space 13 of the housing 11.

At least one first fastener member 19 is coupled to the cover portion 18. At least one second fastener member 20 is coupled to the flap portion 17. The first fastener member 19 is complimentary to the second fastener member 20 whereby the first fastener member 19 is selectively couplable to the second fastener member 20 for securing the cover portion 18 to the flap portion 17.

The first fastener member 19 comprises a first portion of snap fastener 21. The second fastener member 20 comprises a second portion of snap fastener 22. The first portion of snap fastener 21 is complimentary to the second portion of snap fastener 22 whereby the first portion of snap fastener 21 is selectively couplable to the second portion of snap fastener 22.

The perimeter wall 12 of the housing 11 comprises an exterior layer 23 and an interior layer 24. The interior layer 24 of the perimeter wall 12 comprises a compressible material, such as foam padding, whereby compressible material is designed for absorbing the force between the lanyard reel and the head of the user when the lanyard reel impacts the head of the user. The exterior layer 23, comprising fabric, is designed for inhibiting damage to the interior layer 24 when the housing 11 comes into contact with objects in the environment.

In use, the user disengages the first fastener member 19 from the second fastener member 20 and pivots the cover portion 18 away from the flap portion 17 and pivots the flap portion 17 to be substantially aligned with the associated one of the side walls 15. The lanyard reel is then inserted into the interior space 13 of the housing 11 and the flap portion 17 is pivoted back over the lanyard reel. The cover portion 18 is then pivoted back over the flap portion 17 and the first fastener member 19 is coupled to the second fastener member 20 to secure the lanyard reel in the interior space 13 of the housing 11. The lanyard of the lanyard reel is coupled to the safety harness and the securing member of the lanyard reel is coupled to a secure object so that the lanyard reel prevents the user from falling to the floor should the user slip. The interior layer 24 of the perimeter wall 12 of the housing 11 absorbs the impact of the head of the user impacting with the lanyard reel to inhibit injury to the head of the user.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cover apparatus for reducing the force of impact of a lanyard reel connected to a safety harness with a head of a user:

a housing comprising a perimeter wall defining an interior space of said housing, said interior space being adapted for receiving the lanyard reel such that said housing is positioned around the lanyard reel, said housing being adapted for being positioned between the lanyard reel and the head of user for inhibiting injury to the head of the user when the lanyard reel impacts the head of the user; and said perimeter wall of said housing comprising an exterior layer and an interior layer, said interior layer of said perimeter wall comprising a compressible material such that the compressible material is adapted for absorbing the force between the lanyard reel and the head of the user when the lanyard reel impacts the head of the user, said exterior layer being adapted for inhibiting damage to said interior layer when said housing comes into contact with objects in the environment.

2. The cover apparatus as set forth in claim 1, further comprising:

said perimeter wall defining a pair of opposing open ends of said interior space of said housing, one of said open ends of said interior space being adapted for permitting a lanyard to extend from the lanyard reel when the lanyard reel is positioned in said interior space of said housing, the other of said open ends of said interior space of said housing being adapted for permitting a securing member to extend from the lanyard reel when the lanyard reel is positioned in said interior space of said housing.

3. The cover apparatus as set forth in claim 1, further comprising:

said perimeter wall of said housing comprising a pair of side walls and a pair of edge walls, each of said side walls extending between said edge walls such that said side walls are in a spaced relationship, said side walls of said perimeter wall being adapted for being positioned adjacent sides of the lanyard reel when said lanyard reel is positioned in said interior space of said housing, said edge walls being adapted for being positioned adjacent edges of the lanyard reel.

4. The cover apparatus as set forth in claim 3, further comprising:

one of said edge walls of said perimeter wall comprising a flap portion and a cover portion, said flap portion being hingably coupled to one of said side walls and said cover portion being hingably coupled to the other of said side walls, said cover portion being pivotal to be substantially aligned with the associated one of said side walls such that said flap portion is pivotal to be substantially aligned with the associated one of said side walls to permit the lanyard reel to be inserted into said interior space of said housing, said cover portion being pivotal over said flap portion when said flap portion is folded substantially perpendicular to the associated one of said side walls such that said cover portion and said flap portion are adapted for retaining the lanyard reel in said interior space of said housing.

5. The cover apparatus as set forth in claim 4, further comprising:

at least one first fastener member being coupled to said cover portion, at least one second fastener member being coupled to said flap portion, said first fastener member being complimentary to said second fastener member such that said first fastener member is selectively couplable to said second fastener member for securing said cover portion to said flap portion.

6. The cover apparatus as set forth in claim 5, further comprising:

said first fastener member comprising a first portion of snap fastener, said second fastener member comprising a second portion of snap fastener, said first portion of snap fastener being complimentary to said second portion of snap fastener such that said first portion of snap fastener is selectively couplable to said second portion of snap fastener.

7. A cover apparatus for reducing the force of impact of a lanyard reel connected to a safety harness with a head of a user:

a housing comprising a perimeter wall defining an interior space of said housing, said interior space being adapted for receiving the lanyard reel such that said housing is positioned around the lanyard reel, said housing being adapted for being positioned between the lanyard reel and the head of user for inhibiting injury to the head of the user when the lanyard reel impacts the head of the user;

said perimeter wall defining a pair of opposing open ends of said interior space of said housing, one of said open ends of said interior space being adapted for permitting a lanyard to extend from the lanyard reel when the lanyard reel is positioned in said interior space of said housing, the other of said open ends of said interior space of said housing being adapted for permitting a securing member to extend from the lanyard reel when the lanyard reel is positioned in said interior space of said housing;

said perimeter wall of said housing comprising a pair of side walls and a pair of edge walls, each of said side walls extending between said edge walls such that said side walls are in a spaced relationship, said side walls of said perimeter wall being adapted for being positioned adjacent sides of the lanyard reel when said lanyard reel is positioned in said interior space of said housing, said edge walls being adapted for being positioned adjacent edges of the lanyard reel;

one of said edge walls of said perimeter wall comprising a flap portion and a cover portion, said flap portion being hingably coupled to one of said side walls and said cover portion being hingably coupled to the other of said side walls, said cover portion being pivotal to be substantially aligned with the associated one of said side walls such that said flap portion is pivotal to be substantially aligned with the associated one of said side walls to permit the lanyard reel to be inserted into said interior space of said housing, said cover portion being pivotal over said flap portion when said flap portion is folded substantially perpendicular to the associated one of said side walls such that said cover portion and said flap portion are adapted for retaining the lanyard reel in said interior space of said housing;

at least one first fastener member being coupled to said cover portion, at least one second fastener member being coupled to said flap portion, said first fastener member being complimentary to said second fastener member such that said first fastener member is selectively couplable to said second fastener member for securing said cover portion to said flap portion;

said first fastener member comprising a first portion of snap fastener, said second fastener member comprising a second portion of snap fastener, said first portion of snap fastener being complimentary to said second portion of snap fastener such that said first portion of snap fastener is selectively couplable to said second portion of snap fastener; and said perimeter wall of said housing comprising an exterior layer and an interior layer, said interior layer of said perimeter wall comprising a compressible material such that the compressible material is adapted for absorbing the force between the lanyard reel and the head of the user when the lanyard reel impacts the head of the user, said exterior layer being adapted for inhibiting damage to said interior layer when said housing comes into contact with objects in the environment.

8. A cover apparatus for reducing the force of impact of a lanyard reel connected to a safety harness with a head of a user:

a housing comprising a perimeter wall defining an interior space of said housing, said interior space being adapted for receiving the lanyard reel such that said housing is positioned around the lanyard reel, said housing being adapted for being positioned between the lanyard reel and the bead of user for inhibiting injury to the head of the user when the lanyard reel impacts the head of the user;

said perimeter wall of said housing comprising a pair of side walls and a pair of edge walls, each of said side walls extending between said edge walls such that said side walls are in a spaced relationship, said side walls of said perimeter wall being adapted for being positioned adjacent sides of the lanyard reel when said lanyard reel is positioned in said interior space of said housing, said edge walls being adapted for being positioned adjacent edges of the lanyard reel; and one of said edge walls of said perimeter wall comprising a flap portion and a cover portion, said flap portion being hingably coupled to one of said side walls and said cover portion being hingably coupled to the other of said side walls, said cover portion being pivotal to be substantially aligned with the associated one of said side walls such that said flap portion is pivotal to be substantially aligned with the associated one of said side walls to permit the lanyard reel to be inserted into said interior space of said housing, said cover portion being pivotal over said flap portion when said flap portion is folded substantially perpendicular to the associated one of said side walls such that said cover portion and said flap portion are adapted for retaining the lanyard reel in said interior space of said housing.

9. The cover apparatus as set forth in claim 8, further comprising:

said perimeter wall defining a pair of opposing open ends of said interior space of said housing, one of said open ends of said interior space being adapted for permitting a lanyard to extend from the lanyard reel when the lanyard reel is positioned in said interior space of said housing, the other of said open ends of said interior space of said housing being adapted for permitting a securing member to extend from the lanyard reel when the lanyard reel is positioned in said interior space of said housing.

10. The cover apparatus as set forth in claim 8, further comprising:

at least one first fastener member being coupled to said cover portion, at least one second fastener member being coupled to said flap portion, said first fastener member being complimentary to said second fastener member such that said first fastener member is selectively couplable to said second fastener member for securing said cover portion to said flap portion.

11. The cover apparatus as set forth in claim 10, further comprising:

said first fastener member comprising a first portion of snap fastener, said second fastener member comprising a second portion of snap fastener, said first portion of snap fastener being complimentary to said second portion of snap fastener such that said first portion of snap fastener is selectively couplable to said second portion of snap fastener.

* * * * *